United States Patent [19]

Deneke et al.

[11] Patent Number: 4,602,136

[45] Date of Patent: Jul. 22, 1986

[54] MANUAL ACTUATING DEVICE FOR ENCLOSED ELECTRICAL SWITCHES

[75] Inventors: Albert Deneke, Kirke V rl se; Kurt F. L. Pedersen, Hiller d, both of Denmark

[73] Assignee: Aktieselskabet Laur. Knudsen, Nordisk Elektricitets Selskab, Copenhagen, Denmark

[21] Appl. No.: 709,690

[22] PCT Filed: Jun. 18, 1984

[86] PCT No.: PCT/DK84/00055

§ 371 Date: Feb. 15, 1985

§ 102(e) Date: Feb. 15, 1985

[87] PCT Pub. No.: WO85/00073

PCT Pub. Date: Jan. 3, 1985

[30] Foreign Application Priority Data

Jun. 17, 1983 [DK] Denmark ..... 2797/83
Feb. 24, 1984 [DK] Denmark ..... 1019/84

[51] Int. Cl.[4] ..... H01H 9/20
[52] U.S. Cl. ..... 200/50 A; 361/344
[58] Field of Search ..... 200/50 A, 50 AA; 361/344

[56] References Cited

U.S. PATENT DOCUMENTS 2,698,361 12/1954 Mekelburg ..... 200/50 A
2,806,099 9/1957 Rexroad ..... 200/50 A
2,885,502 5/1959 Eichelberger et al. ..... 200/50 AA
2,961,501 11/1960 Piteo, Jr. ..... 200/50 A

FOREIGN PATENT DOCUMENTS 1805220 5/1970 Fed. Rep. of Germany .
1951640 7/1971 Fed. Rep. of Germany .

*Primary Examiner*—Roy N. Envall, Jr.
*Assistant Examiner*—Morris Ginsburg
*Attorney, Agent, or Firm*—Cushman, Darby & Cushman

[57] ABSTRACT

A manual device for operating an electrical switch. The handle is mounted in the door of the cubicle in which the switch is mounted. The device compensates for misalignment due to mounting tolerances and establishes a locking of the door in certain positions of the handle and switch. These functions are obtained by means of a misalignment compensating unit which is completely enclosed in a housing (10). The outer shape of the housing (10) interacts with a well (13) in the handle, and the rear part of the housing (10), one edge of which has a taper (18), interacts with a device in the shape of a slide (17).

5 Claims, 4 Drawing Figures

MANUAL ACTUATING DEVICE FOR ENCLOSED ELECTRICAL SWITCHES

The invention relates to a manual actuating device for an electrical switch which is built into a cubicle with the operating handle rotatably mounted in a door, of the kind that comprises misalignment compensating means and with interlocks to prevent undesirable operation.

In order to enhance safety and for protection against the environment, industrial switches are frequently enclosed in cubicles. However, it is desirable to operate such switches without having to open the door of the cubicle, and the switch is supplied with an axle of a length suitable for the mounting of an operating handle on the outside of the door. However, it is important to be able to open the door in order to change fuses or the like, and the handle is therefore often supported in the door and connected to the switch axle by means of a claw coupling. However, safety requires that the door may only be opened when the switch is in its "off" position, and hence the handle is often connected with locking means for the door. There are further safety requirements that the handle shall only be connectable to the switch when the position of the handle and the position of the switch agree. In practical mounting of switches in cubicles and handles in doors certain misalignments are inavoidable, and hence there is a requirement that compensating means will allow friction-free operation in any case.

Several solutions to the above requirements are known. Common to them all is that they consist of loose parts that have to be mounted in correct mutual relationship on handle and switch axle respectively. This reduces security in that the possibility of errors increases and it also contributes to greater assembly time. In particular the locking of the door is complicated, and in most cases it is dependent on correct engagement of the locking device and the part that is connected to the switch axle.

These disadvantages are all avoided by means of the actuating device according to the invention which is characteristic in that the misalignment compensating means constitute an enclosed unit which is fastened to the switch axle and in that its outer shape and engagement with the handle which is mounted in the door control the logical functioning of the interlocks.

The invention is to be further described with reference to the drawing in which

Figure 2:
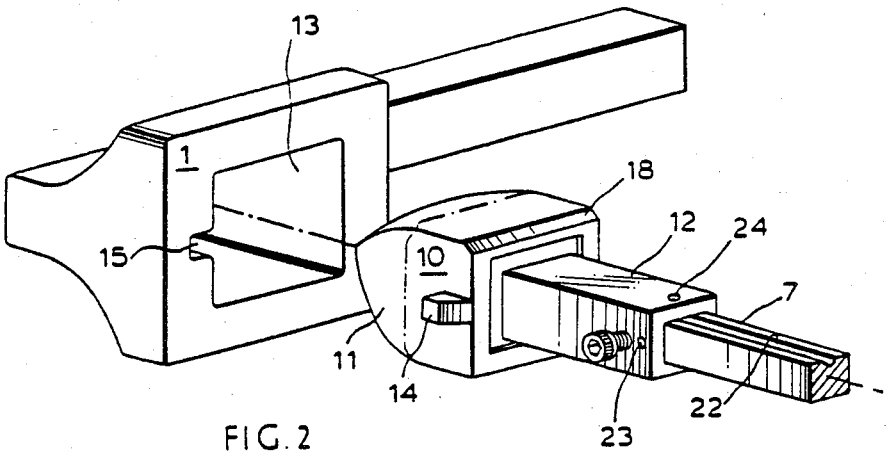
FIG. 2 shows a construction according to the invention.
Figure 3A:
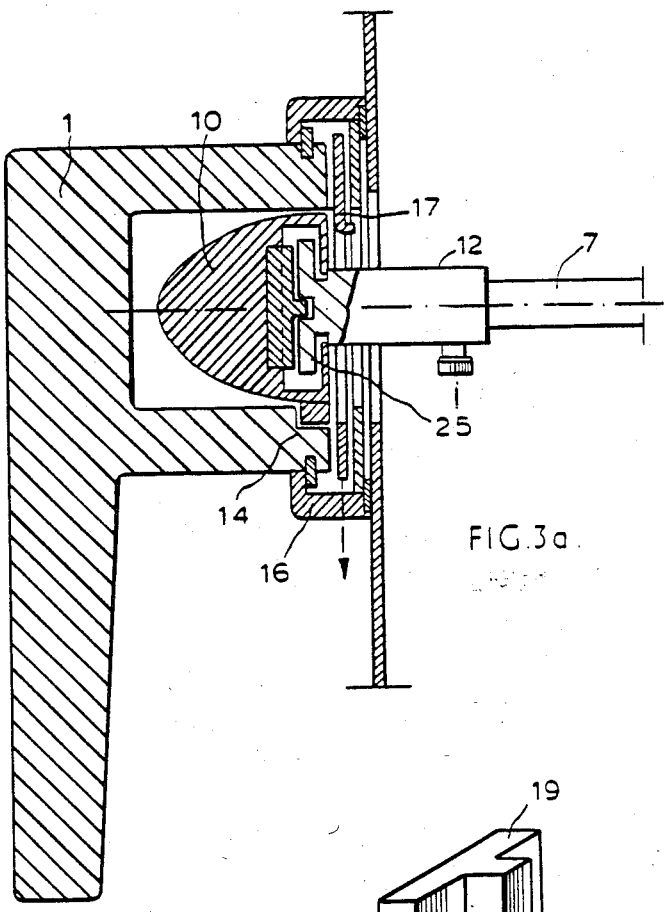
Figure 3B:
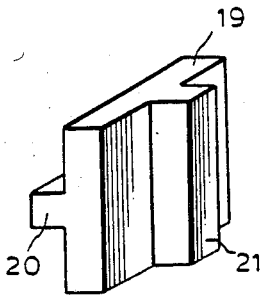

FIGS. 3*a* and 3*b* shows details in the construction of FIG. 2.

Figure 1:
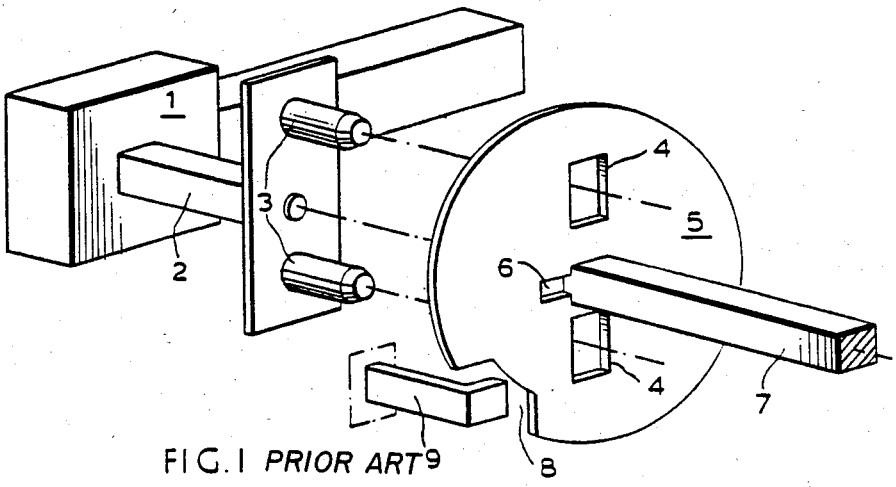
FIG. 1 PRIOR ART
FIG. 1 shows a construction according to the state of the art.

In FIG. 1 is shown the state of the art of a handle with misalignment compensating means for actuating a switch and with interlock to ensure that the door carrying the handle is locked when the switch is in the "on" position. A handle (1) is mounted on an axle (2) which is rotatably disposed in the door (not shown). The axle (2) carries a cross plate with projecting pins (3) which may engage slits (4) in an essentially circular disc (5). A further slit (6) is provided perpendicular to the first slits (4) surrounding the centre of the disc (5). In the slit is disposed the end of the actuating axle (7) of a switch. As the length of the slit (6) is greater than the width of the square axle (7) the disc (5) may perform a sideways motion on the switch axle (7). The disc (5) furthermore has a cut-out (8) covering part of the perifery. When using this, well-known, actuating device the length of the axle (7) has to be adjusted according to the mounting of the switch in the cubicle. The pins (3) and the slits (4) must get into engagement, and this can only occur when there is agreement between the position of the handle and the position of the switch. In case there is a certain misalignment between the directions of the axles (2) and (7) relative displacements between the pins (3) and the slits (4) and of the axle (7) in the slit (6) provide compensation during rotation of the handle, thus transmitting torque from the handle to the switch in order to let it operate. In order to obtain a locking action on the door when the switch is in the "on" position, a claw (9) which is mounted on the inside of the door projects in order that it grips the disc (5) unless it has a position corresponding to switch "off". In this position only, the claw is opposite the cut-out (8) in the disc (5).

It is apparent that an actuating device according to the state of the art as described above has certain mechanical weaknesses and disadvantages in use. In case the misalignment between the handle in the door and the switch in the cubicle is large a large compensatory movement is required. This will increase wear, in particular in the slit (6) which again leads to undesirable slack in the movement. The claw (9) must have a large capture area in that it shall not only function properly in case of slack but also in case of full compensatory movement of the pins (3) in the slits (4) which gives the disc (5) a translatory movement as well as a rotation. The amount of compensation that this construction may give is limited by the fact that there is only a 90 degree movement involved in the actuation of most switches.

These disadvantages are completely avoided by the construction according to the invention shown in FIG. 2. A housing (10) which has a taper (11) contains the misalignment compensating means, and it is mounted on the switch axle (7) by means of a sleeve (12). The taper (11) eases introduction into and engagement with a well (13) in the handle (1). The handle (1) is rotatably mounted on the door which is not shown. The housing (10) for the misalignment compensating means carries on one of its sides a projection (14) which corresponds to a slot (15) in the well (13) of the handle (1) when the well (13) has the correct position with respect to the housing (10). In close proximity to the well (13) there is disposed a slide (17) carried in the bearing (16) of the handle, which slide is spring loaded as shown by the downwards pointing arrow of FIG. 3*a*. The slide (17) is forced aside when the housing (10) is introduced into the well (13), and upon completion of this operation the slide moves back by spring pressure and so prevents the pulling out of the housing (10). This function is used for locking the door in that the handle may not be separated from the switch axle (7) in this position (the "on" position"). There is in practise a possibility of overriding the interlock by insertion of a special tool from the outside of the door, however this is not shown as it is a part of the state of the art. The door must be openable in the "off" position of the switch, and this is obtained by means of a tapered back edge (18) of the housing (10) which may push back the slide (17) and so allow withdrawal of the housing (10) from the well (13). The major advantage of the interlocking obtained by means of the invention as compared to the state of the art is that the interlock acts on a part (10) of the actuating means that has already had its position mechanically corrected. This means that the interlocking means does not need to have a large capture area because they always have to act the same place, and normal mechanical tolerances may be used in order to obtain easy introduction and withdrawal.

On FIG. 2 it may further be seen how it has been obtained that there is always the same relationship between the position of handle and switch as prescribed by the manufacturer. By certain means this may be obtained in the case where the switch has a permanently fixed axle as well as in the case where an axle of square cross section is cut and pushed home in a hole provided in the switch. In the latter case there is the only requirement that there be provided in the hole a protusion or tab. The device thus functions in the following manner: the axle (7) with the slot or groove (22) is cut from stock and one end is put in the hole with a tab provided in the switch (not shown). This can only be performed one way. Subsequently the misalignment compensating means contained in the housing (10) are mounted on the axle (7) by means of the sleeve (12). Similarly this can only be performed one way because there is fitted an inwards projecting pin in the hole (24) so that the axle (7) can only be pushed into the sleeve (12) when the pin is allowed to slide in the groove (22). The sleeve is fixed to the axle by means of the screw shown. The door may be shut closed when the projection (14) is introduced in the slot (15) in the handle, and only under those circumstances. Hereby it is unambiguously ensured that one may read the position of the switch from the position of the handle with the door closed. In case a certain absolute requirements as to the position of the handle have to be adhered to (e.g. vertical signifies "on", horizontal signifies "off"), certain problems might occur if a switch can only be mounted one way for reasons of space in the cubicle, and when the groove in the switch axle is disposed for the other way of mounting. In this case the pin in the hole (24) in the sleeve (12) may be driven out by a conscious use of tools and placed in the hole (23) instead, thus compensating for the changed mounting of the switch. There are typically 4 holes in the sleeve (12) corresponding to 4 different orientations of the groove (22) with which the pin has to cooperate.

In FIG. 3 is shown the heart of the misalignment compensating means enclosed in the housing (10). This is the part that compensates for the switch axle (7) not necessesarily having the same axis of rotation as the handle (1), even though they may be parellel. It is a question of transmitting a rotational movement between two parallel axles, and from a kinematic point of view it is performed the same way as described in connection with known constructions. That is, use is made of two sliding movements in directions perpendicular to each other. According to the invention this is obtained by means of the part shown in FIG. 3*b* consisting of a plate (19) carrying tounges (20) and (21) perpendicular to each other. These interact with grooves in the housing (10) and in that part of the sleeve (12) which extends into the housing and which carries a collar (25) which is larger than the hole allowing the extension into the housing (10). The part shown in FIG. 3*b* transmits the movement of the handle (1) which drives the housing (10) of the misalignment compensating means, to the switch axle (7) through the sleeve (12). This is shown by means of different hatchings on FIG. 3*a*. The grooves are longer than the tounges (20) and (21) in order to permit the sideways movement in perpendicular directions. It should again be pointed out that kinematically the part shown in FIG. 3*b* performs the same action as the circular disc (5) in FIG. 1. However it is not to act as a door interlock as in the state of the art. In the present invention door interlock is performed on the hindmost part of an element, the position of which has already been compensated for.

Because the locking of the door occurs by means of a slide moving in parallel to the door, it is a simple matter to obtain both locking of the door as well as locking of the movement of the handle by means of a pin which is controlled from the outside of the handle. This pin is pushed in parallel with the axis of rotation of the handle in order to engage holes at selected places in slide and in door. A pin of this kind may be locked by means of a padlock which ensures that only authorized access to activation or opening of the door can occur.

The following advantages accrue from the actuating device according to the invention having the misalignment compensating means permanently mounted on the switch axle: the construction is smaller, lubrication is permanent, the weight and parts count are smaller, and the mounting of the handle in the door is greatly simplified in that there is no need for careful mounting of interlocking means.

We claim:

1. A manual actuating device for an electric switch which is built into a cubicle and adapted to be activated by means of a handle mounted on an openable door via a rotatable switch shaft, said actuating device comprising: a first coupling member rotatably mounted in a door and fixedly connected to a handle and a second coupling member mounted on the switch shaft, said two coupling members being adapted to telescopingly engage with each other by closing the door and comprising mutually cooperating guiding surfaces which make the insertion of one of said coupling members into the other possible irrespective of misalignment therebetween by means of misalignment compensating means, and blocking means to secure against opening and closing of the door while the switch is connected, characterized in that said second coupling member comprises an engaging member cooperating with said first coupling member and a mounting member fixedly mounted on the switch shaft, said engaging member and said mounting member being mutually connected by means of said misalignment compensating means which is adapted to make possible the adjustment of said engaging member in any direction perpendicular to the axis of the switch shaft.

2. An actuating device according to claim 1, characterized in that the outer shape of the engaging member is non-rotationally-symmetric and shaped as a male member tapered in the direction toward said first coupling member and the latter is shaped as a female member complementary to and for reception of said male member.

3. An actuating device according to claim 1, characterized in that the blocking means comprise a spring biased guideway plate in a bearing of the handle and adapted to be dislocated by means of the engaging member of the second coupling member during its reception into the first coupling member, and that said guideway plate comprises parts for cooperating with an inclined surface situated on an edge area of said engaging member, when the latter together with the handle is in the switch-off position so that the mutual blocking of the coupling members is released by opening the door.

4. An actuating device according to claim 3, characterized in that the guideway plate can be blocked by means which are operable and lockable from the front of the handle.

5. An actuating device according to claim 1, characterized in that the mounting member of the second coupling member comprises a bushing to receive the switch shaft, said bushing comprising at least two bores to mount an inwardly protruding pin for cooperation with a longitudinal slot on the switch shaft by insertion of the shaft into said bushing.

* * * * *